US011345516B2

(12) United States Patent
Scott

(10) Patent No.: US 11,345,516 B2
(45) Date of Patent: May 31, 2022

(54) RECYCLABLE BEVERAGE CONTAINER CARRYING BAG

(71) Applicant: Randy D. Scott, Lake Orion, MI (US)

(72) Inventor: Randy D. Scott, Lake Orion, MI (US)

(73) Assignee: Randy D. Scott, Lake Orion, MI (US)

( * ) Notice: Subject to any disclaimer, the term of this patent is extended or adjusted under 35 U.S.C. 154(b) by 0 days.

(21) Appl. No.: 16/411,903

(22) Filed: May 14, 2019

(65) Prior Publication Data

US 2020/0039695 A1 Feb. 6, 2020

Related U.S. Application Data

(60) Provisional application No. 62/713,628, filed on Aug. 2, 2018.

(51) Int. Cl.

| | |
|---|---|
| ***B65D 33/00*** | (2006.01) |
| ***B65D 30/22*** | (2006.01) |
| ***B65D 33/25*** | (2006.01) |
| ***B65D 33/10*** | (2006.01) |

(52) U.S. Cl.

CPC ..... *B65D 31/12* (2013.01); *B65D 33/105* (2013.01); *B65D 33/25* (2013.01)

(58) Field of Classification Search

CPC ..... B65D 31/12; B65D 33/105; B65D 33/25
USPC ..... 224/16, 41
See application file for complete search history.

(56) References Cited

U.S. PATENT DOCUMENTS 3,213,628 A * 10/1965 Serota ..... E02B 3/108 405/111
3,473,713 A * 10/1969 Campbell ..... B60R 7/04 224/484
4,542,824 A * 9/1985 Allen ..... A47G 25/54 190/111
4,738,363 A 4/1988 Hudson
4,877,068 A 10/1989 Blake
4,883,169 A 11/1989 Flanagan, Jr.
5,201,446 A * 4/1993 Martin ..... A01D 46/22 206/523

(Continued)

OTHER PUBLICATIONS

GroVia Perect Pail, product advertisement on: https://www.amazon.com/gp/product/B00B1FS87K/ref=as_li_tl?ie=UTF8&camp=1789&creative=390957&creativeASIN=B00B1FS87K&link..., last accessed Jun. 10, 2018, at 4:14 PM.

(Continued)

*Primary Examiner* — Peter N Helvey
(74) *Attorney, Agent, or Firm* — Quinn IP Law

(57) ABSTRACT

An apparatus includes a housing, first handles, second handles and zippers. The housing may be (i) made of a flexible material and (ii) have compartments. The first handles may be (i) attached to an end of the housing and (ii) configured to hang the housing in an upright orientation. The second handles may be attached to another end of the housing. The housing is generally configured to bend such that the first handles are aligned with the second handles to facilitate carrying of the housing. The zippers may be configured to provide an opening into a corresponding compartment suitable to pass recyclable beverage containers. Each compartment may have (i) a zipper proximate a top end of the compartment to insert the recyclable beverage containers and (ii) another zipper proximate a bottom end of the compartment to remove the recyclable beverage containers.

20 Claims, 8 Drawing Sheets

(56) References Cited

U.S. PATENT DOCUMENTS

| | | | | |
|---|---|---|---|---|
| 5,240,112 | A * | 8/1993 | Newburger | B65D 33/2508 206/524.8 |
| 5,362,153 | A * | 11/1994 | Lu | B60N 3/08 220/495.06 |
| 5,427,453 | A * | 6/1995 | Cloessner | A45C 3/00 190/109 |
| 5,503,476 | A * | 4/1996 | Hamdan | D06F 95/002 224/585 |
| 5,706,940 | A * | 1/1998 | Amarello | A45C 11/22 206/320 |
| 6,244,484 | B1 * | 6/2001 | Farrell | A45C 3/001 190/111 |
| 6,659,273 | B1 * | 12/2003 | Scola | A45C 15/00 206/285 |
| 8,863,950 | B2 * | 10/2014 | Ormsby | A45C 11/00 206/289 |
| 2009/0173646 | A1 | 7/2009 | Blomberg | |
| 2010/0003887 | A1 * | 1/2010 | Greene | B65D 29/04 446/75 |

OTHER PUBLICATIONS

Umbra Blue Recycle Crunch Can with Handles, product advertisement on: https://www.containersstore.com/s/storage/storage-bags-totes/umbra-blue-recycle-crunch-can-with-handles/12d?productId=10031901&countr..., last accessed Jun. 8, 2018, at 4:14 PM.

* cited by examiner

RECYCLABLE BEVERAGE CONTAINER CARRYING BAG

This application relates to U.S. Provisional Application No. 62/713,628, filed Aug. 2, 2018, which is hereby incorporated by reference in its entirety.

FIELD OF THE INVENTION

The invention relates to recyclable containers generally and, more particularly, to a method and/or apparatus for implementing a recyclable container carrying bag.

BACKGROUND

Storage and transportation of empty soda, beer and other cans and bottles can be troublesome. A collection of many recyclable containers over time consumes a considerable amount of storage space. Moving a large number of containers from the storage space to a recycling center commonly involves garbage bags. Full garbage bags can be heavy and difficult to lift and carry. The garbage bags are also tied closed to avoid spilling the recyclable containers during transpiration. The knots at the end of the garbage bags are sometimes difficult to untie at the recycling center.

It would be desirable to implement a recyclable container carrying bag.

SUMMARY

The invention concerns an apparatus including a housing, first handles, second handles and zippers. The housing may be (i) made of a flexible material and (ii) have compartments. The first handles may be (i) attached to an end of the housing and (ii) configured to hang the housing in an upright orientation. The second handles may be attached to another end of the housing. The housing is generally configured to bend such that the first handles are aligned with the second handles to facilitate carrying of the housing. The zippers may be configured to provide an opening into a corresponding compartment suitable to pass recyclable beverage containers. Each compartment may have (i) a zipper proximate a top end of the compartment to insert the recyclable beverage containers and (ii) another zipper proximate a bottom end of the compartment to remove the recyclable beverage containers.

BRIEF DESCRIPTION OF THE FIGURES

Embodiments of the invention will be apparent from the following detailed description and the appended claims and drawings in which:

DETAILED DESCRIPTION OF THE EMBODIMENTS

Embodiments of the present invention include providing a recyclable container carrying bag that may (i) occupy a small foot print while accumulating containers, (ii) provide handles for hanging, (iii) provide handles for easy carrying, (iv) include resealable openings along a bottom for quick removal of the containers, (v) provide multiple compartments for keeping different types of containers separated and/or (vi) be implemented with a flexible materials.

Figure 1:
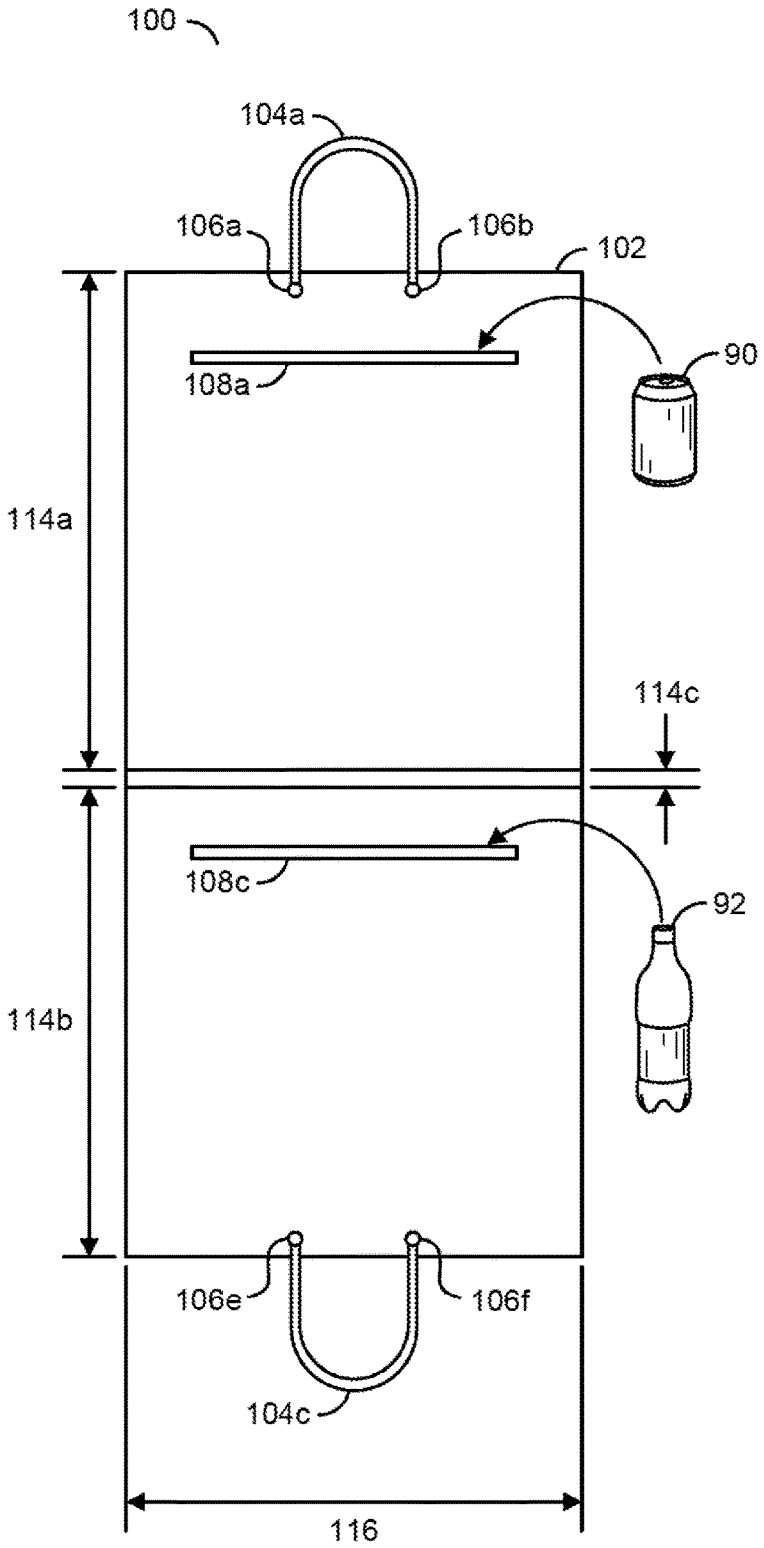
FIG. 1 is a diagram of a front view of an apparatus in accordance with an embodiment of the invention.

Referring to FIG. 1, a diagram of a front view of an example implementation of an apparatus 100 is shown in accordance with an embodiment of the invention. The apparatus (or system or device) 100 may implement a bag suitable for carrying one or more types of recyclable beverage containers. The apparatus 100 generally comprises a component (or part) 102, multiple components (or parts) 104*a* to 104*d* (104*a* and 104*c* shown), multiple components (or parts) 106*a* to 106*g* (106*a*, 106*b*, 106*e* and 106*f* shown), and multiple components (or parts) 108*a* to 108*d* (108*a* and 108*c* shown).

The component 102 may implement a housing. The housing 102 may include multiple (e.g., two) compartments. Each compartment of the housing 102 may be operational to store, transport and discharge multiple beverage containers 90 to 92. In normal use, the beverage containers 90 to 92 may be empty. In various embodiments, the housing 102 may be used with full containers 90 to 92. The multiple compartments of the housing 102 generally allow for the separation of different types of containers 90 to 92. For example, some types of containers (e.g., containers 90) may be stored and transported in one compartment while other types of containers (e.g., containers 92) may be stored and transported in another compartment. In various embodiments, the housing 102 may be fabricated of a flexible material including, but not limited to plastic, vinyl, leather, nylon, rubber or any combination of the materials. Other materials may be used to meet the design criteria of a particular application.

Each component 104*a* to 104*d* may implement a handle. Each handle 104*a* to 104*d* may be attached to a corresponding side of the housing 102. In an example embodiment, two of the handles 104*a* and 104*b* may be attached at one end of the housing 102 (e.g., a top end as illustrated in the figure). The other two handles 104*c* and 104*d* may be attached at another end of the housing 102 opposite the handles 104*a* and 104*b* (e.g., a bottom end as illustrated in the figure). The handles 104*a* to 104*d* may be used to hang the housing from a hook or peg on a wall, door, cabinet, coat rack or other structure suitable to hold the weight of the apparatus 100 when filled with recyclable containers 90 to 92. In various embodiments, the handles 104*a* to 104*d* may be fabricated with plastic, vinyl, leather, nylon, chord, rubber, or any combination of materials. Other materials may be used to meet the design criteria of a particular application. The handles 104*a* to 104*d* may also be created in different styles and/or shapes other that as shown in the figure. In various embodiments, the handles 104*a* to 104*d* may be configured for ease of hanging. For example, the handles 104*a* to 104*d* may be integrated to fit into a top of a door frame and still allow the door to close. In other embodiments, the handles 104*a* to 104*d* may be configured for ease of carrying.

The components 106*a* to 106*g* may implement rivets. The rivets 106*a* to 106*g* are generally operational to fasten the handles 104*a* to 104*d* to the housing 102. In various embodiments, each end of each handle 104*a* to 104*d* may be attached to the housing with a rivet 106*a* to 106*g*. In other embodiments, other numbers of rivets 106*a* to 106*g* may be used to secure the handles 104*a* to 104*g* to the housing 102.

The components 108*a* to 108*d* may implement zippers. The zippers 108*a* to 108*d* are generally operational to enable passage of the containers 90 to 92 into and out of the compartments of the housing 102. In various embodiments, the zipper 108*a* may be located in a sidewall of the housing 102 at the compartment near the handle 104*a*. The zipper 108*c* may be located in the sidewall of the housing 102 at the compartment near the handle 104*c*. The zippers 108*a* and 108*c* are generally opened to allow insertion of the containers 90 to 92 into the housing 102. The zippers 108*a* and 108*c* may be closed during transportation of the assembly 100 to a recycling center to keep the containers 90 to 92 from falling out of the housing 102.

The housing 102 generally has a height dimension, illustrated as 114*a*+114*b*+114*c*. In various embodiments, each dimension 114*a* and 114*b* may be approximately two feet (e.g., 20 to 28 inches). The dimension 114*c* may be a few inches (e.g., 3 to 7 inches). The housing 102 may have a width dimension 116. In an example embodiment, the dimension 116 may also be approximately 2 feet (e.g., 24 to 30 inches). In an example embodiment of 27 inches wide by 53 inches high by 6 inches deep, the assembly 100 may hold approximately a hundred cans 90 among the two compartments. Other dimensions may be implemented to meet the design criteria of a particular application.

Figure 2:
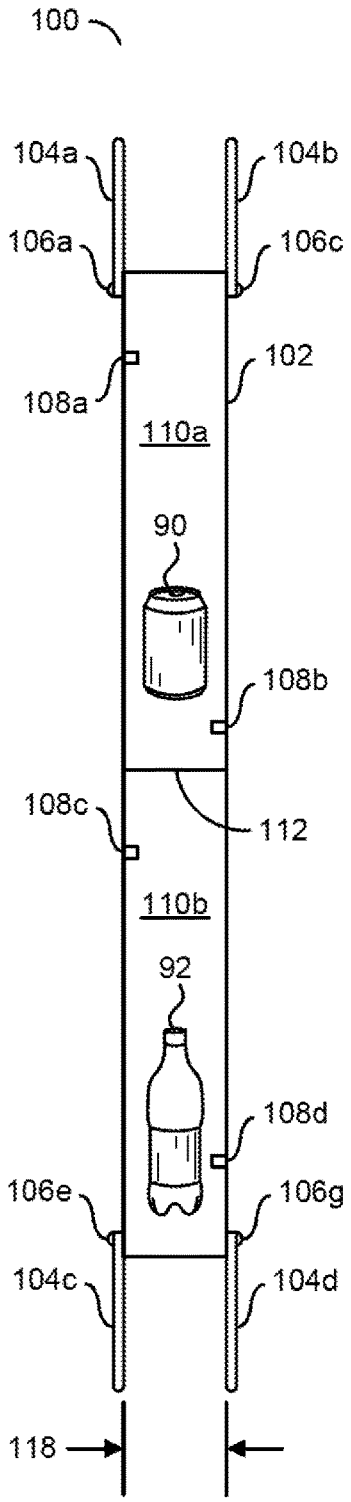
FIG. 2 is a diagram of a cutaway side view of the assembly of FIG. 1 in accordance with an embodiment of the invention.

Referring to FIG. 2, a diagram of a cutaway side view of the example embodiment of the assembly 100 is shown in accordance with an embodiment of the invention. The housing 102 may be divided into multiple (e.g., two) compartments 110*a* and 110*b*. A barrier 112 may separate the two compartments 110*a* and 110*b*.

The handles 104*a* and 104*b* may be located parallel to each other at one end of the compartment 110*a*. The handles 104*c* and 104*c* may be located parallel to each other at an opposite end of the compartment 110*b*. The zippers 108*a* and 108*b* may open into the compartment 110*a*. The zippers 108*c* and 108*d* may open into the compartment 110*b*.

The housing 102 may have a depth 118. In various embodiments, the depth 118 may be a few inches (e.g., 5 inches to 16 inches). Other depths may be implemented to meet the criteria of a particular application.

In various embodiments, the zippers 108*a* to 108*d* and the compartments 110*a* to 110*b* may be configured to hold different types of beverage containers 90 to 92. In an example embodiment, the zippers 108*a* and 108*b* and the compartment 110*a* may be sized to hold beverage-can type containers 90. While beverage-can type containers are illustrated, other types of containers may be stored and transported inside the compartment 110*a*. The zippers 108*c* and 108*d* and the compartment 110*b* may be sized to hold beverage bottle sized containers 92. While beverage-bottle type containers are illustrated, other types of containers may be stored and transported inside the compartment 110*b*. In other embodiments, the zippers 108*a* to 108*d* and the compartments 110*a* to 110*b* may be configured to hold the same type of beverage container 90 to 92.

Figure 3:
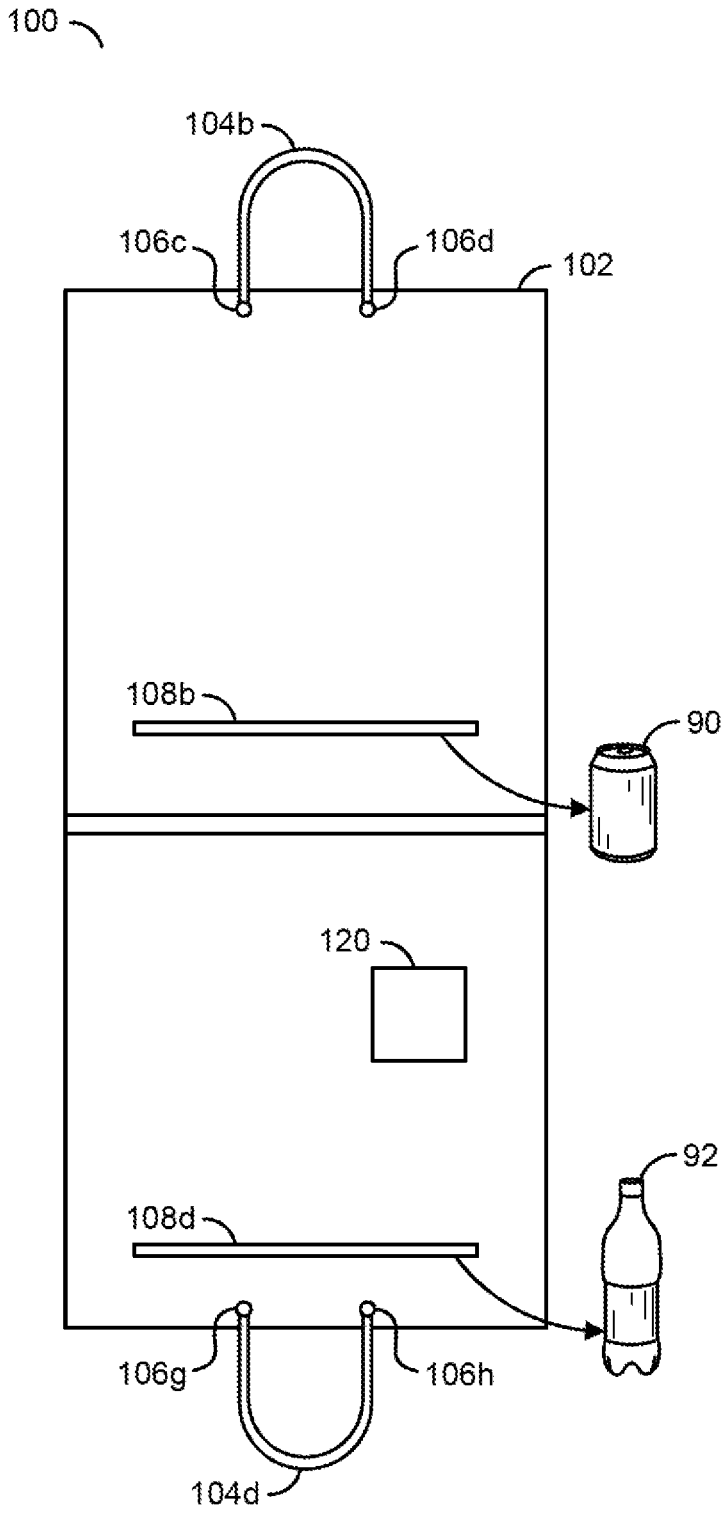
FIG. 3 is a diagram of a back view of the assembly of FIG. 1 in accordance with an embodiment of the invention.

Referring to FIG. 3, a diagram of a back view of the example embodiment of the assembly 100 is shown in accordance with an embodiment of the invention. The assembly 100 may further comprise a component (or part) 120.

The component 120 may implement a glove pouch. The pouch 120 is generally attached to an outer surface of the housing 102. An opening in the pouch 120 may allow one or more pairs of gloves to be inserted and removed from the pouch 120.

The handle 104*b* may be attached to the housing 102 in alignment with the handle 104*a*. The handle 104*d* may be attached to the housing 102 in alignment with the handle 104*c*.

The zipper 108*b* may open to the compartment 110*a* near the center of the housing 102. As such, any containers 90 to 92 within the compartment 110*a* may be easily removed through an open zipper 108*b*. During storage and transportation, the zipper 108*b* may be closed to keep the containers 90 to 92 within the compartment 110*a*.

The zipper 108*d* may open to the compartment 110*b* near the handle 104*d*. As such, any containers 90 to 92 within the compartment 110*b* may be easily removed through an open zipper 108*d*. During storage and transportation, the zipper 108*d* may be closed to keep the containers 90 to 92 within the compartment 110*b*.

In an example storage operation, the assembly 100 may be hung from a peg using the handles 104*a* and/or 104*b*. In an example embodiment, an "S" hook may be used between the peg and the handles 104*a* and/or 104*b*. The hanging orientation places the zippers 108*a* and 108*c* at the top of the compartments 110*a* and 110*b*, respectively. Open zippers 108*a* and 108*c* generally allow the containers 90 to 92 to be inserted into the compartments 110*a* and 110*b* for storage. The bottom zippers 108*b* and 108*d* may be closed to retain the containers 90 to 92 inside the housing 102.

In an example transportation operation, the open zippers 108*a* and 108*c* may be closed. The assembly 100 may subsequently be removed from the peg. A height of the assembly 100 may be reduced by folding the housing 102 along the middle section causing the four handles 104*a* to 104*d* to align with each other. The assembly 100 may thus be transported by holding the handles 104*a* to 104*d* in one or two hands.

In an example emptying operation, the assembly 100 may be hung up again (as shown in the figures). The zippers 108*b* and 108*d* may be opened and the containers 90 to 92 allowed to fall out of the housing 102. In another example emptying operation, the assembly 100 may remain folded in half. With the assembly 100 being held up by the handles 104*a* to 104*d*, the zippers 108*b* and 108*c* may be opened to allow the containers 90 to 92 to be removed from the bottom of the compartments 110*a* and 110*b*.

Figure 4:
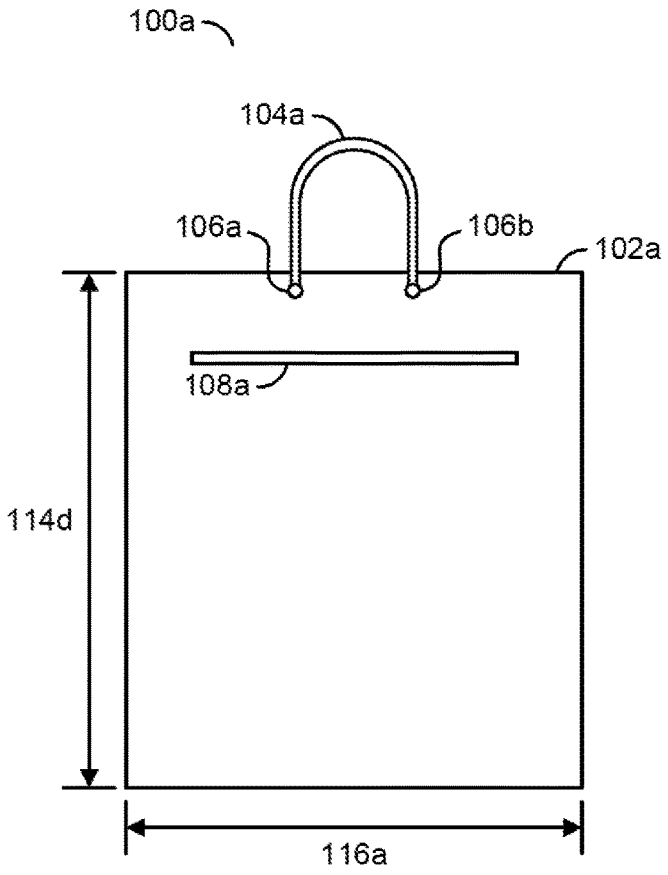
FIG. 4 is a diagram of a front view of another assembly in accordance with an embodiment of the invention.

Referring to FIG. 4, a diagram of a front view of an example implementation of an assembly 100*a* is shown in accordance with an embodiment of the invention. The assembly 100*a* may be a variation of the assembly 100. The apparatus (or system or device) 100*a* may implement a bag suitable for carrying one or more types of recyclable beverage containers. The apparatus 100*a* generally comprises a component (or part) 102*a*, the handles 104*a* to 104*b*, the rivets 106*a* to 106*d* and the zippers 108*a* and 108*b*.

The component 102*a* may implement a housing. The housing 102*a* may be a shorter version of the housing 102. The housing 102*a* may be fabricated from the same material as the housing 102. The housing 102*a* may have a height 114*d* and a width 116*a*. In various embodiments, the height 114*d* may be approximately two feet (e.g., 20 to 28 inches). The width 116*a* may be may also be approximately 2 feet (e.g., 24 to 30 inches). In an example embodiment of 27 inches wide by 25 inches high by 6 inches deep, the assembly 100*a* may hold approximately twenty-five cans 90. Other dimensions may be implemented to meet the design criteria of a particular application.

Figure 5:
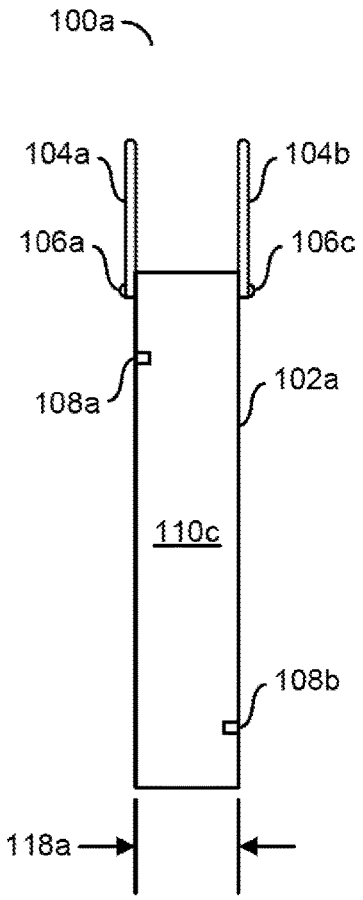
FIG. 5 is a diagram of a cutaway side view of the assembly of FIG. 4 in accordance with an embodiment of the invention.

Referring to FIG. 5, a diagram of a cutaway side view of the example embodiment of the assembly 100*a* is shown in accordance with an embodiment of the invention. The housing 102*a* may implement a single compartment 110*c*. The handles 104*a* and 104*b* may be located parallel to each other at one end of the compartment 110*c*. The zippers 108*a* and 108*b* may open into the compartment 110*c*.

The housing 102*a* may have a depth 118*a*. In various embodiments, the depth 118*a* may be a few inches (e.g., 5 inches to 16 inches). Other depths may be implemented to meet the design criteria of a particular application.

Figure 6:
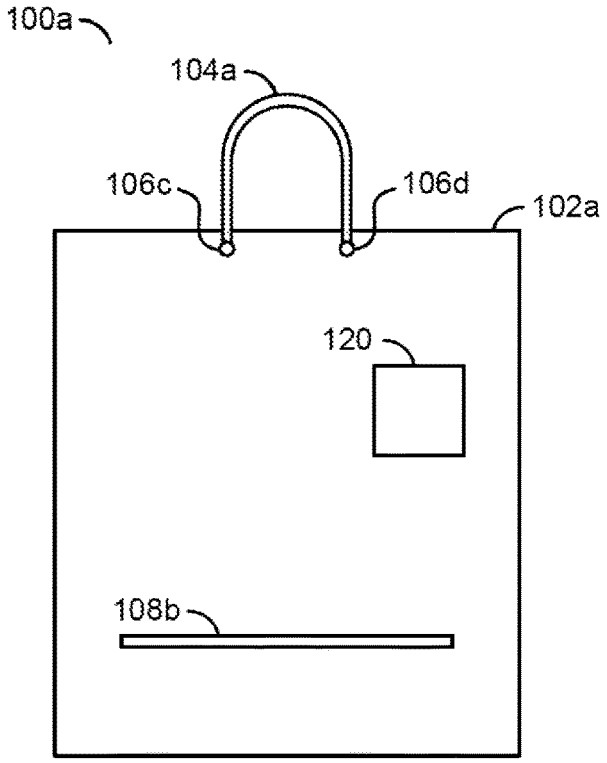
FIG. 6 is a diagram of a back view of the assembly of FIG. 4 in accordance with an embodiment of the invention.

Referring to FIG. 6, a diagram of a back view of the example embodiment of the assembly 100*a* is shown in accordance with an embodiment of the invention. The assembly 100*a* may further comprise the glove pouch 120.

The component 120 may implement a glove pouch. The pouch 120 is generally attached to an outer surface of the housing 102*a*. An opening in the pouch 120 may allow one or more pairs of gloves to be inserted and removed from the pouch 120.

The handle 104*b* may be attached to the housing 102*a* in alignment with the handle 104*a*.

The zipper 108*b* may open to the compartment 110*c* near the far end of the housing 102*a*, opposite the handles 104*a* and 104*b*. As such, any containers 90 to 92 within the compartment 110*c* may be easily removed through an open zipper 108*b*. During storage and transportation, the zipper 108*b* may be closed to keep the containers 90 to 92 within the compartment 110*a*.

Figure 7:
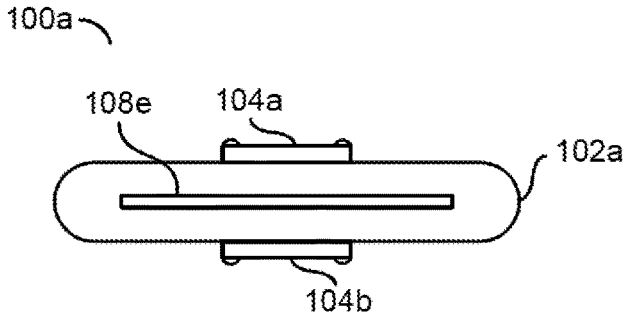
FIG. 7 is a diagram of a top view of the assembly of FIG. 4 in accordance with an embodiment of the invention.

Referring to FIG. 7, a diagram of a top view of the example implementation of the assembly 100*a* is shown in accordance with an embodiment of the invention. In various embodiments, the assembly 100*a* may include an optional zipper 108*e*. The zipper 108*e* may be disposed in a top side of the housing 102*a* approximately between the handles 104*a* and 104*b*. The zipper 108*e* may in communication with the compartment 110*c*. The zipper 108*e* may be opened to provide simple insertion and/or removal of the containers 90 to 92 from the assembly 100*a*.

Figure 8:
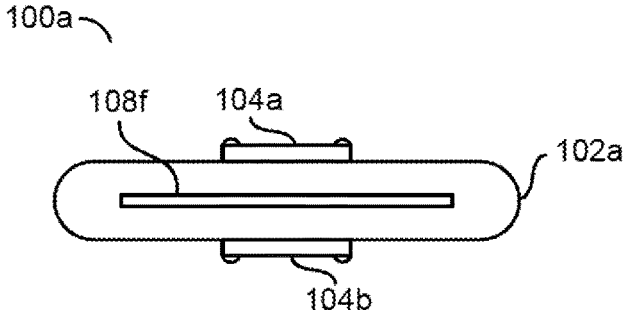
FIG. 8 is a diagram of a bottom view of the assembly of FIG. 4 in accordance with an embodiment of the invention.

Referring to FIG. 8, a diagram of a bottom view of the example implementation of the assembly 100*a* is shown in accordance with an embodiment of the invention. In various embodiments, the assembly 100*a* may include another optional zipper 108*f*. The zipper 108*f* may be disposed approximately centered in a bottom side of the housing 102*a*. The zipper 108*f* may in communication with the compartment 110*c*. The zipper 108*f* may be opened to provide removal of the containers 90 to 92 from the assembly 100*a*.

In an example storage operation, the assembly 100*a* may be hung from a peg or door handle using the handles 104*a* and/or 104*b*, or placed on a surface such as a table or counter. The hanging/placed orientation may result in the zippers 108*a* and 108*e* being at the top of the compartment 110*c*. Open zippers 108*a* and/or 108*e* generally allow the containers 90 to 92 to be inserted into the compartment 110*c* for storage. The bottom zippers 108*b* and 108*f* may be closed to retain the containers 90 to 92 inside the housing 102*a*.

In an example transportation operation, the open zippers 108*a* and 108*e* may be closed. The assembly 100*a* may subsequently be removed from the peg/door handle or picked up off the table/counter. The assembly 100*a* may be transported by holding the handles 104*a* to 104*d* in one or two hands.

In an example emptying operation, the assembly 100*a* may be hung up again. The zippers 108*b* and/or 108*f* may be opened and the containers 90 to 92 allowed to fall out of a bottom of the housing 102*a*. In another example emptying operation, the assembly 100*a* may be placed on a counter. Thereafter, the zippers 108*a* and/or 108*e* may be opened to allow the containers 90 to 92 to be removed through the top of the housing 102.

Figure 9:
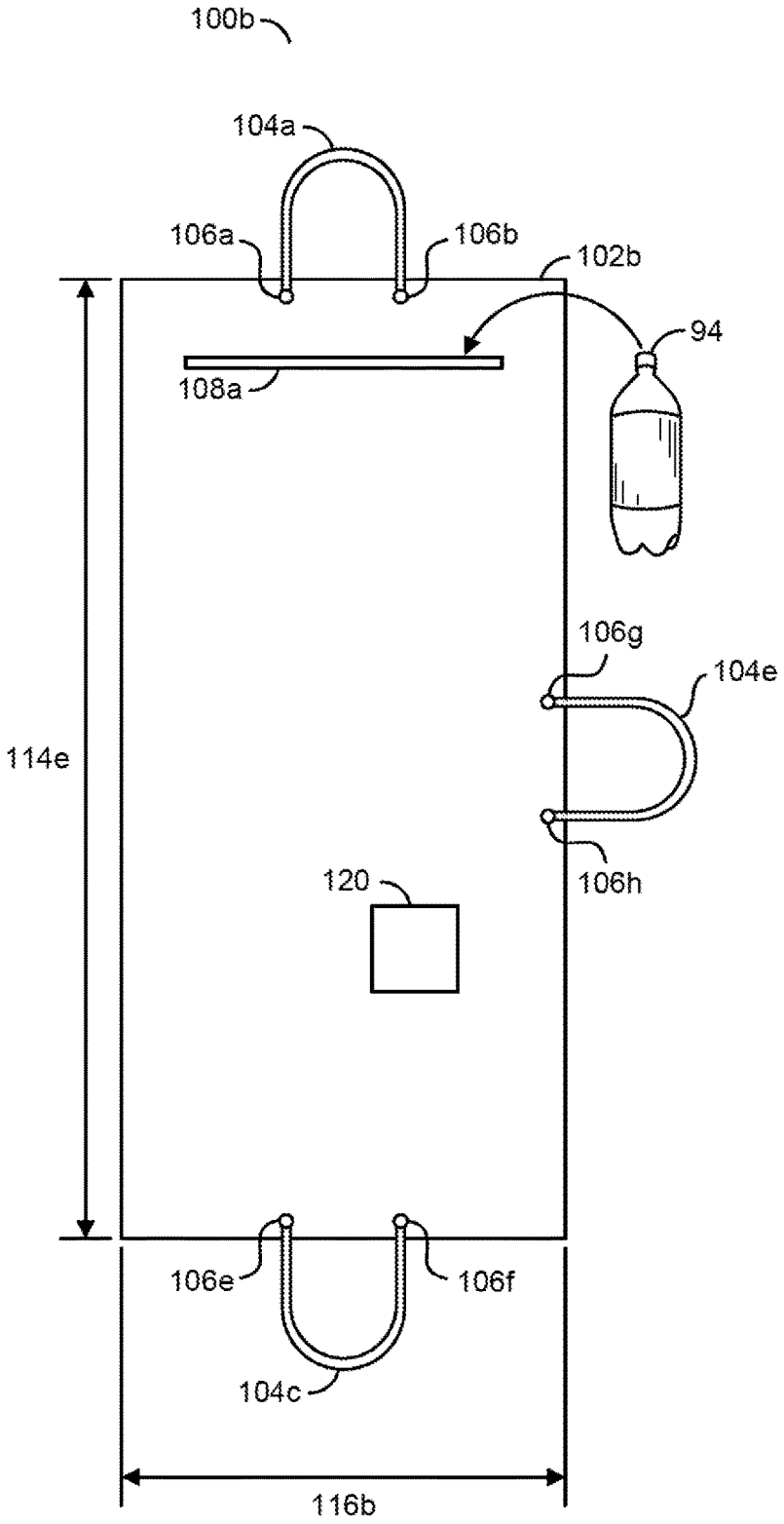
FIG. 9 is a diagram of a front view of yet another assembly in accordance with an embodiment of the invention.

Referring to FIG. 9, a diagram of a front view of an example implementation of an assembly 100*b* is shown in accordance with an embodiment of the invention. The assembly 100*b* may be a variation of the assembly 100 and/or 100*a*. The apparatus (or system or device) 100*b* may implement a bag suitable for carrying one or more types of recyclable beverage containers. The apparatus 100*b* generally comprises a component (or part) 102*b*, the handles 104*a* to 104*f*, the rivets 106*a* to 106*j*, the zippers 108*a* and 108*b* and the glove pouch 120.

The housing 102*b* may be a variation of the housing 102. The housing 102*b* may be fabricated from the same material as the housing 102.

The additional handles 104*e* and 104*f* (only handle 104*e* is shown) may be attached to the housing 102*b* via the rivets 106*g* to 106*j*. The handle 104*e* may be located approximately halfway between the handles 104*a* and 104*c*.

The zippers 108*a* and 108*b* and a compartment formed in the housing 102*b* may be sized to enable insertion and removal of larger beverage containers 94 (e.g., 2-liter plastic bottles). The zippers 108*a* and 108*b* may also accommodate the smaller containers 90 and 92.

The housing 102*b* may have a height 114*e* and a width 116*b*. In various embodiments, the height 114*d* may be approximately five feet (e.g., 54 to 66 inches). The width 116*b* may be approximately 2 feet (e.g., 24 to 30 inches). Other dimensions may be implemented to meet the design criteria of a particular application.

In an example embodiment of 27 inches by 60 inches by 5 inches deep, the assembly 100*b* may hold approximately a hundred and fifty can-type containers 90, approximately eighty-five bottle-type containers 92, approximately sixty 2-liter type containers 94 or a combination of any two or three types of the containers 90 to 94.

Figure 10:
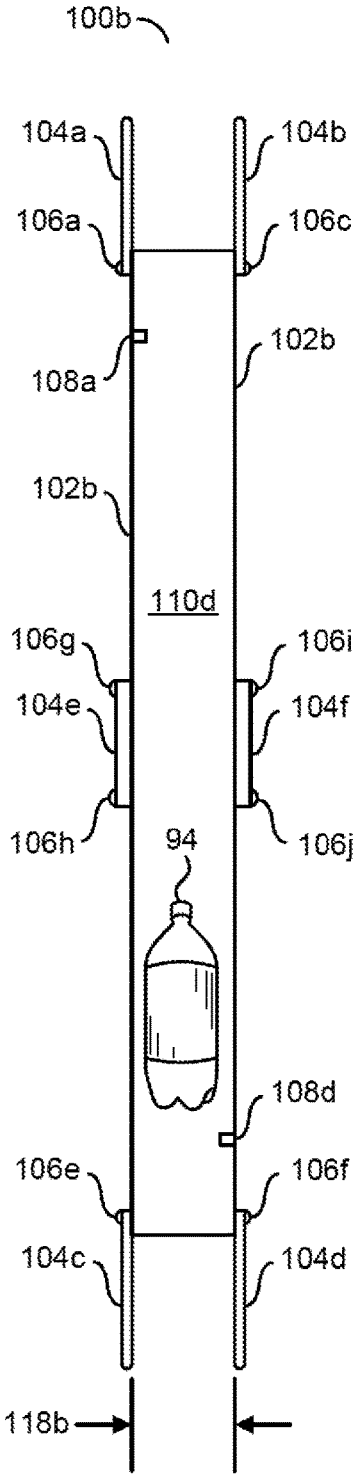
FIG. 10 is a diagram of a cutaway side view of the assembly of FIG. 9 in accordance with an embodiment of the invention.

Referring to FIG. 10, a diagram of a cutaway side view of the example embodiment of the assembly 100*b* is shown in accordance with an embodiment of the invention. The housing 102*b* may implement a single compartment 110*d*. The handles 104*a* and 104*b* may be located parallel to each other at one end of the compartment 110*d*. The handles 104*c* and 104*d* may be located parallel to each other at the other end of the compartment 110*d*. The handles 104*e* and 104*f* may be located parallel to each other approximate a center of the compartment 110*d*. The zippers 108*a* and 108*b* may be in communication with the compartment 110*d*.

The housing 102*b* may have a depth 118*b*. In various embodiments, the depth 118*b* may be a few inches (e.g., 5 inches to 16 inches). Other depths may be implemented to meet the design criteria of a particular application.

Figure 11:
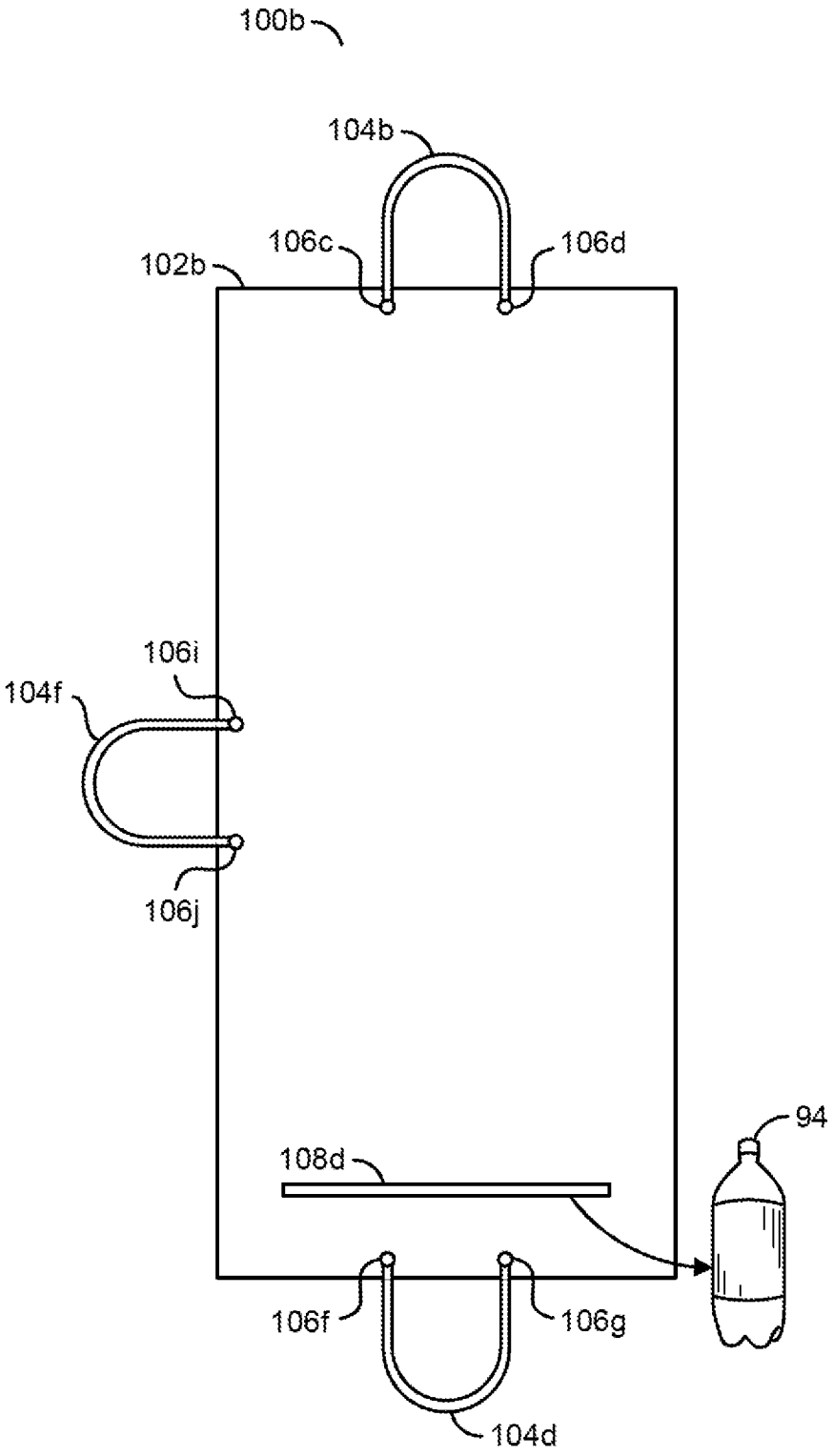
FIG. 11 is a diagram of a back view of the assembly of FIG. 9 in accordance with an embodiment of the invention.

Referring to FIG. 11, a diagram of a back view of the example embodiment of the assembly 100*b* is shown in accordance with an embodiment of the invention. The handle 104*f* may be attached to the housing 102*b* in alignment with the handle 104*e*.

The zipper 108*b* may open to the compartment 110*d* near the handle 104*d*. As such, any containers 90 to 94 within the compartment 110*d* may be easily removed through an open zipper 108*b*. During storage and transportation, the zipper 108*b* may be closed to keep the containers 90 to 94 within the compartment 110*d*.

In an example storage operation, the assembly 100*b* may be hung from a peg using the handles 104*a* and/or 104*b*. The hanging orientation places the zipper 108*a* at the top of the compartment 110*d*. Open zipper 108*a* generally allows the containers 90 to 94 to be inserted into the compartment 110*d* for storage. The bottom zipper 108*b* may be closed to retain the containers 90 to 94 inside the housing 102*b*.

In an example transportation operation, the open zipper 108*a* may be closed. The assembly 100*b* may subsequently be removed from the peg. The assembly 100*b* may be rotated until the handles 104*e* and 104*f* are upright. The assembly 100*b* may be subsequently transported by holding the handles 104*e* to 104*f* in one or two hands.

In an example emptying operation, the assembly 100*b* may be hung up again (as shown in the figures). The zipper 108*b* may be opened and the containers 90 to 94 allowed to fall out of the compartment 110*d*.

Figure 12:
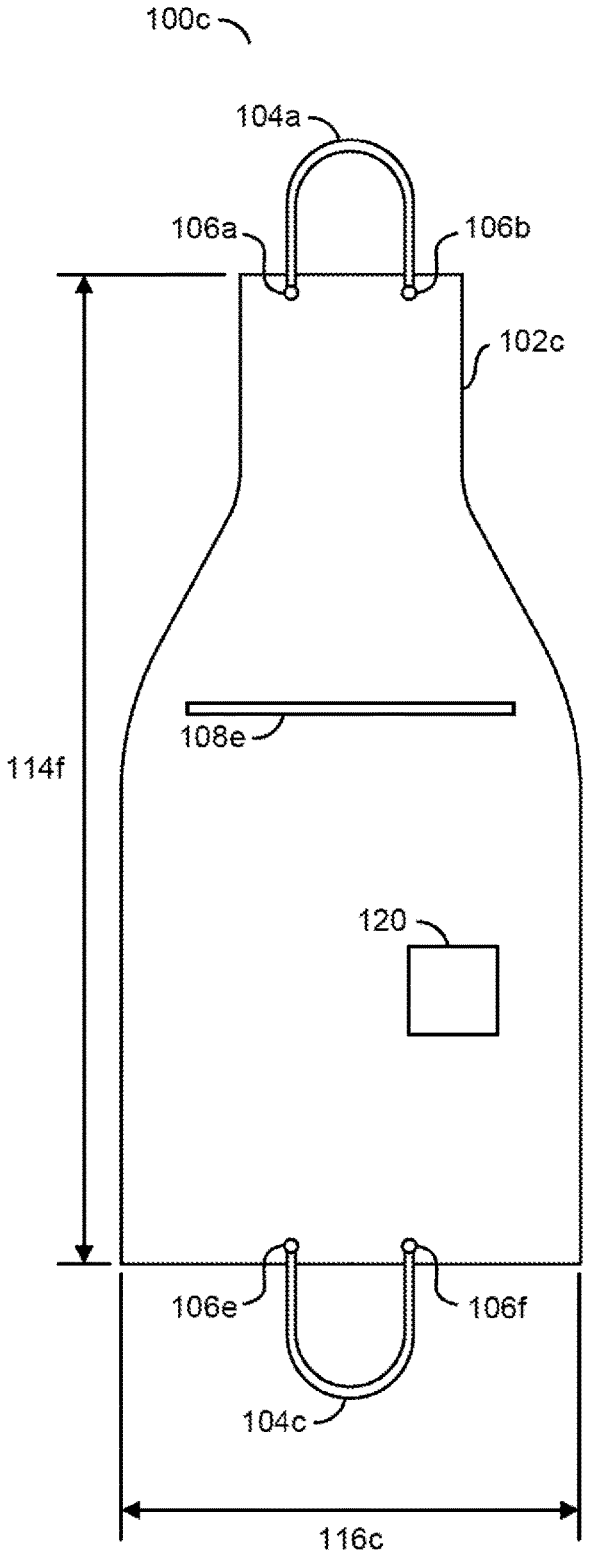
FIG. 12 is a diagram of a front view of still another assembly in accordance with an embodiment of the invention.

Referring to FIG. 12, a diagram of a front view of an example implementation of an assembly 100*c* is shown in accordance with an embodiment of the invention. The assembly 100*c* may be a variation of the assembly 100, 100*a* and/or 100*b*. The apparatus (or system or device) 100*c* may implement a bag suitable for carrying one or more types of recyclable beverage containers. The apparatus 100*c* generally comprises a component (or part) 102*c*, the handles 104*a* to 104*b*, the rivets 106*a* to 106*d*, the zippers 108*a* and 108*f* and the glove pouch 120.

The housing 102*c* may be fabricated from the same material as the housing 102. The housing 102*c* may be fabricated in a shape of a bottle. Other shapes of the housing 102*c* may be implemented to meet the design criteria of a particular application. Logos, messages and/or artwork may be displayed on a face of the housing 102*c*.

The handles 104*a* and 104*b* may be located proximate a narrower "neck" portion of the housing 102*c*. In various embodiments, the zipper 108*a* may be located below the neck portion of the housing 102*c*. In other embodiments, the zipper 108*a* may be located along the neck portion of the housing 102*c*.

The housing 102*c* may have a height 114*f* and a width 116*c*. In various embodiments, the height 114*f* may be approximately five feet (e.g., 54 to 66 inches). The width 116*c* may be approximately 2 feet (e.g., 24 to 30 inches). Other dimensions may be implemented to meet the design criteria of a particular application.

In an example embodiment of 27 inches by 60 inches by 6 inches deep, the assembly 100*c* may hold approximately a hundred and twenty-five can-type containers 90, approximately sixth-five bottle-type containers 92, approximately forty 2-liter type containers 94 or a combination of any two or three types of containers 90 to 94.

Figure 13:
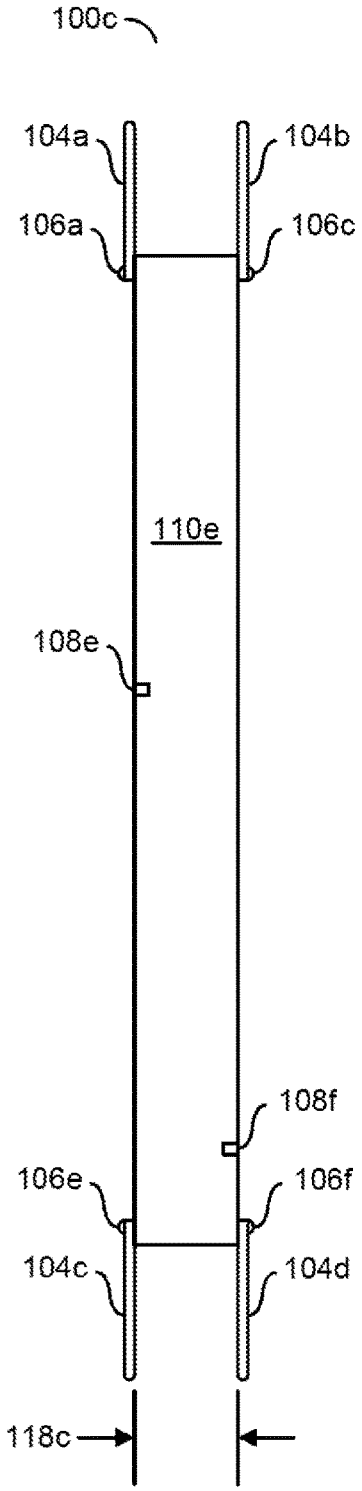
FIG. 13 is a diagram of a cutaway side view of the assembly of FIG. 12 in accordance with an embodiment of the invention.

Referring to FIG. 13, a diagram of a cutaway side view of the example embodiment of the assembly 100*c* is shown in accordance with an embodiment of the invention. The housing 102*c* may implement a single compartment 110*e*. The handles 104*a* and 104*b* may be located parallel to each other at one end of the compartment 110*e*. The handles 104*c* and 104*d* may be located parallel to each other at an opposite end of the compartment 110*e*. The zippers 108*a* and 108*f* may open into the compartment 110*e*.

The housing 102*c* may have a depth 118*c*. In various embodiments, the depth 118*c* may be a few inches (e.g., 5 inches to 16 inches). Other depths may be implemented to meet the design criteria of a particular application.

Figure 14:
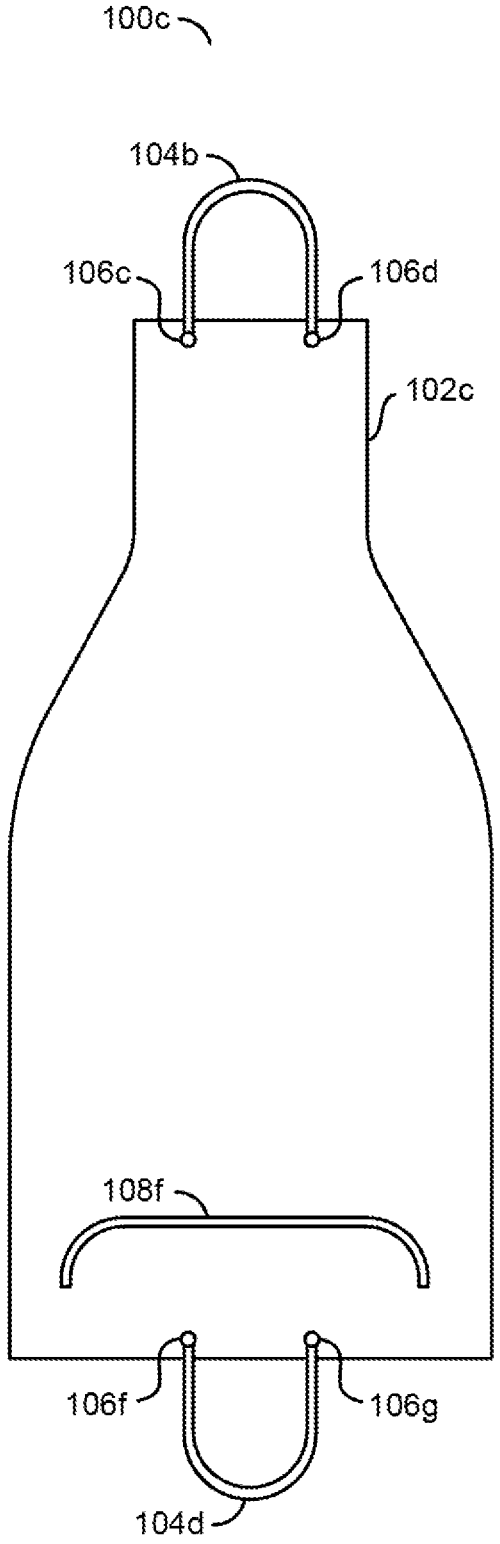
FIG. 14 is a diagram of a back view of the assembly of FIG. 12 in accordance with an embodiment of the invention.

Referring to FIG. 14, a diagram of a back view of the example embodiment of the assembly 100*c* is shown in accordance with an embodiment of the invention. The handle 104*b* may be attached to the housing 102*c* in alignment with the handle 104*a*. The handle 104*d* may be attached to the housing 102*c* in alignment with the handle 104*c*.

The zipper 108*f* may open to the compartment 110*e* near the handle 104*d*. As such, any containers 90 to 94 within the compartment 110*e* may be easily removed through an open zipper 108*f* During storage and transportation, the zipper 108*f* may be closed to keep the containers 90 to 92 within the compartment 110*d*.

In an example storage operation, the assembly 100*c* may be hung from a peg using the handles 104*a* and/or 104*b*. The hanging orientation places the zipper 108*a* at the top of the compartment 110*e*. Open zipper 108*a* generally allows the containers 90 to 94 to be inserted into the compartment 110*e* for storage. The bottom zipper 108*f* may be closed to retain the containers 90 to 94 inside the housing 102*b*.

In an example transportation operation, the open zipper 108*a* may be closed. The assembly 100*c* may subsequently be removed from the peg. The assembly 100*c* may be transported by holding the handles 104*e* to 104*f* in one or two hands.

In an example emptying operation, the assembly 100*c* may be hung up again (as shown in the figures). The zipper 108*f* may be opened and the containers 90 to 94 allowed to fall out of the housing 102*c*.

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. An apparatus comprising:

a housing (i) made of a flexible material, (ii) having a plurality of compartments, (iii) having two opposing sidewalls separated by approximately five inches to approximately seven inches while said compartments are empty, and (iv) having a volume that accommodates at least 25 beverage can-sized ones of said recyclable beverage container;

two first handles (i) directly attached to said two opposing sidewalls respectively along an upper edge of said housing, (ii) extended from where directly attached to said two opposing sidewalls, across said upper edge, and beyond said upper edge in a first direction parallel to said two opposing sidewalls, (iii) mirror each other about said upper edge, and (iv) configured to hang said housing in an unfolded and upright orientation while extended beyond said upper edge in said first direction;

two second handles (i) directly attached to said two opposing sidewalls respectively along a lower edge of said housing opposite said upper edge, (ii) extended from where directly attached to said two opposing sidewalls, across said lower edge, and beyond said lower edge in a second direction opposite said first direction, and (iii) mirror each other about said lower edge, wherein said housing is configured to bend in half such that said first handles are aligned with said second handles to facilitate carrying of said housing while said housing is held by said first handles and said second handles; and only two zippers per each of said plurality of compartments, each of said only two zippers is oriented parallel to said upper edge and is configured to provide an opening into a corresponding one of said compartments suitable to pass one or more of said recyclable beverage containers, wherein each of said compartments has (i) only one of said only two zippers disposed on a first of said two opposing sidewalls proximate a top end of said compartment to insert said recyclable beverage containers and (ii) only another one of said only two zippers disposed on a second of said two opposing sidewalls proximate a bottom end of said compartment to remove said recyclable beverage containers.

2. The apparatus according to claim 1, further comprising at least one pouch disposed on one of said two opposing sidewalls of said housing.

3. The apparatus according to claim 1, further comprising two third handles (i) directly attached to said two opposing sidewalls respectively along a side edge of said housing, (ii) extended from where directly attached to said two opposing sidewalls, across said side edge, and beyond said side edge in a third direction perpendicular to said first direction, and (iii) mirror each other about said side edge, wherein said side edge extends between said upper edge and said lower edge.

4. The apparatus according to claim 1, wherein said housing has a shape of a bottle.

5. An apparatus comprising:

a housing (i) made of a flexible material, (ii) having one or more compartments, (iii) having two opposing sidewalls separated by approximately five inches to approximately seven inches while said compartments are empty, and (iv) having a volume that accommodates at least 25 beverage can-sized ones of said recyclable beverage container;

two first handles (i) directly attached to said two opposing sidewalls respectively along an upper edge of said housing, (ii) extended from where directly attached to said two opposing sidewalls, across said upper edge, and beyond said upper edge in a first direction parallel to said two opposing sidewalls, (iii) mirror each other about said upper edge, (iv) configured to hang said housing in an unfolded and upright orientation while extended beyond said upper edge in said first direction, and (v) configured to facilitate carrying of said housing while said housing is held by said first handles; and only two zippers per each of said one or more compartments, each of said only two zippers is oriented parallel to said upper edge and is configured to provide an opening into a corresponding one of said compartments suitable to pass one or more of said recyclable beverage containers, wherein each of said compartments has (i) only a first one of said only two zippers disposed on a first of said two opposing sidewalls proximate a top end of said compartment to insert said recyclable beverage containers and (ii) only a second one of said only two zippers disposed on a second of said two opposing sidewalls proximate a bottom end of said compartment to remove said recyclable beverage containers.

6. The apparatus according to claim 5, further comprising two second handles (i) directly attached to said two opposing sidewalls respectively along a lower edge of said housing opposite said upper edge, (ii) extended from where directly attached to said two opposing sidewalls, across said lower edge, and beyond said lower edge in a second direction opposite said first direction, and (iii) mirror each other about said lower edge, wherein said housing is configured to bend in half such that said first handles are aligned with said second handles to facilitate carrying of said housing.

7. The apparatus according to claim 5, where said one or more compartments comprises two compartments.

8. The apparatus according to claim 5, further comprising at least one pouch disposed on one of said two opposing sidewalls of said housing.

9. The apparatus according to claim 5, further comprising two second handles (i) directly attached to said two opposing sidewalls respectively along a side edge of said housing, (ii) extended from where directly attached to said two opposing sidewalls, across said side edge, and beyond said side edge in a second direction perpendicular to said first direction, and (iii) mirror each other about said side edge, wherein said side edge is perpendicular to said upper edge.

10. The apparatus according to claim 5, wherein said housing has a shape of a bottle.

11. An apparatus comprising:

a housing (i) made of a flexible material, (ii) having a single compartment, (iii) having two opposing sidewalls separated by approximately five inches to approximately seven inches while said compartment is empty, and (iv) having a volume that accommodates at least 25 beverage can-sized ones of said recyclable beverage container;

two first handles (i) directly attached to said two opposing sidewalls respectively along an upper edge of said housing, (ii) extended from where directly attached to said two opposing sidewalls, across said upper edge, and beyond said upper edge in a first direction parallel to said two opposing sidewalls, (iii) mirror each other about said upper edge, and (iv) configured to hang said housing in an unfolded and upright orientation while extended beyond said upper edge in said first direction;

two second handles (i) directly attached to said two opposing sidewalls respectively along a lower edge of said housing opposite said upper edge, (ii) extended from where directly attached to said two opposing sidewalls, across said lower edge, and beyond said lower edge in a second direction opposite said first direction, and (iii) mirror each other about said lower edge, wherein said housing is configured to bend in half such that said first handles are aligned with said second handles to facilitate carrying of said housing while said housing is held by said first handles and said second handles; and only two zippers each oriented parallel to said upper edge and configured to provide an opening into said compartment to pass one or more of said recyclable beverage containers, wherein said compartment (i) only a first one of said only two zippers disposed on a first of said two opposing sidewalls proximate a top end of said compartment to insert said recyclable beverage containers and (ii) only a second one of said only two zippers disposed on a second of said two opposing sidewalls proximate a bottom end of said compartment to remove said recyclable beverage containers.

12. The apparatus according to claim 11, further comprising at least one pouch disposed on one of said two opposing sidewalls of said housing.

13. The apparatus according to claim 11, further comprising two third handles (i) directly attached to said two opposing sidewalls respectively along a side edge of said housing, (ii) extended from where directly attached to said two opposing sidewalls, across said side edge, and beyond said side edge in a third direction perpendicular to said first direction, and (iii) mirror each other about said side edge, wherein said side edge extends between said upper edge and said lower edge.

14. The apparatus according to claim 11, wherein said housing has a shape of a bottle.

15. The apparatus according to claim 11, wherein a height of said housing as measured perpendicular to said upper edge is approximately 2.5 times greater than a width of said housing as measured along said upper edge.

16. The apparatus according to claim 5, wherein a height of said housing as measured perpendicular to said upper edge is greater than a width of said housing as measured along said upper edge.

17. The apparatus according to claim 16, wherein a depth of said housing as measured between said two opposing sidewalls is less than said width.

18. The apparatus according to claim 11, wherein a height of said housing as measured perpendicular to said upper edge is greater than a width of said housing as measured along said upper edge.

19. The apparatus according to claim 1, wherein a height of said housing as measured perpendicular to said upper edge is greater than a width of said housing as measured along said upper edge.

20. The apparatus according to claim 19, wherein a depth of said housing as measured between said two opposing sidewalls is less than said width.

* * * * *